United States Patent [19]

Bessho

[11] 4,170,112

[45] Oct. 9, 1979

[54] INTERNAL COMBUSTION ENGINE OF CLEANED EXHAUST GAS

[75] Inventor: Hironori Bessho, Susono, Japan

[73] Assignee: Toyota Jidosha Kogyo Kabushiki Kaisha, Aichi, Japan

[21] Appl. No.: 830,790

[22] Filed: Sep. 6, 1977

[30] Foreign Application Priority Data

Jul. 23, 1977 [JP] Japan ..... 52-087884

[51] Int. Cl.[2] ..... F01N 3/10; F02M 23/08

[52] U.S. Cl. ..... 60/278; 60/290

[58] Field of Search ..... 60/278, 289, 290, 306

[56] References Cited

U.S. PATENT DOCUMENTS

| | | | |
|---|---|---|---|
| 3,869,858 | 3/1975 | Goto | 60/306 |
| 3,921,396 | 11/1975 | Nohira | 60/306 |
| 3,948,044 | 4/1976 | Wakita | 60/278 |
| 3,983,697 | 10/1976 | Goto | 60/306 |
| 4,070,830 | 1/1978 | Beiswenger | 60/306 |
| 4,088,101 | 5/1978 | Wakita | 60/278 |

FOREIGN PATENT DOCUMENTS

| | | | |
|---|---|---|---|
| 2558357 | 8/1976 | Fed. Rep. of Germany | 60/306 |

*Primary Examiner*—Douglas Hart

*Attorney, Agent, or Firm*—Stevens, Davis, Miller & Mosher

[57] ABSTRACT

Disclosed is an internal combustion engine provided with an exhaust gas recirculation system for recirculating exhaust gas from at least one but not all of the combustion chambers into an intake manifold. This internal combustion engine is also provided with an air injection system for introducing an appropriate amount of secondary air necessary for maintaining an effective exhaust gas recirculation operation. Means are provided for introducing an excessive amount of secondary air into the exhaust system at positions located near the combustion chambers including the chamber from which exhaust gas is recirculated, when the engine is operating under a warming-up condition. Accordingly, a catalytic converter located downstream of the exhaust manifold is rapidly activated just after the starting of the cold engine for oxidizing CO and HC components in the exhaust manifold.

1 Claim, 3 Drawing Figures

INTERNAL COMBUSTION ENGINE OF CLEANED EXHAUST GAS

FIELD OF THE INVENTION

The present invention relates to an internal combustion engine provided with both an exhaust gas recirculation (EGR) system and an air injection system, for effectively eliminating three major toxic components in the exhaust gas of the engine.

BACKGROUND OF THE INVENTION

An EGR system is effective for decreasing the amount of $NO_x$ in the exhaust gas since the combustion temperature in the combustion chambers of the engine is decreased by introducing recirculated gas into the combustion chambers. An air injection system is effective for decreasing the amounts of HC and CO in the exhaust gas, since the injected air serves to oxidize the HC and CO components in the catalytic converter. Therefore, in order to effectively decrease the three major toxic components, i.e. HC, CO and $NO_x$, an internal combustion engine of a type provided with both an EGR system and an air injection system has also been proposed in the prior art. In such type of engine, if a large amount of injected secondary air is mixed with the exhaust gas to be recirculated, a combustible mixture from a carburetor of the engine becomes "lean", thereby causing an inferior EGR effect. This condition is due to the high temperature of the combustion of the "lean" mixture in the combustion chambers, which combustion generates a large amount of $NO_x$ components. Already provided in the prior art is an engine which prevents the mixing of injected secondary air with the exhaust gas to be recirculated. Such engine has an EGR system for recirculating exhaust gas, from at least one but not all of the combustion chambers into the intake manifold, and an air injection system for introducing secondary air into branch pipes connected to combustion chambers from which the exhaust gas is not recirculated. By the above-mentioned construction, the mixing of the injected air with the exhaust gas to be recirculated is prevented. Accordingly, the effect of decreasing $NO_x$ by utilizing the EGR operation as well as the effect of decreasing CO and HC by utilizing the air injection operation can be sufficiently attained.

However, in this type of internal combustion, since the secondary air is not introduced into all of the exhaust ports leading from the combustion chambers, oxidation of the HC and CO components does not occur at the exhaust ports, to which the secondary air is not introduced. Therefore, a low temperature of the exhaust gas directed toward the catalytic converter exists for a prolonged time after the cold start of the engine. Such low temperature causes the occurrence of an inferior operation in the catalytic converter. Consequently, a large amount of CO and HC components is emitted to the atmosphere without being cleaned during the warming-up condition of the engine.

SUMMARY OF THE INVENTIONS

An object of the present invention is to provide an internal combustion engine having both an EGR system and an air injection system, capable of effectively decreasing CO and HC emissions into the atmosphere during an engine warming-up period.

Another object of the present invention is to provide an internal combustion engine having both an EGR system and an air injection system, capable of introducing an excessive amount of secondary air into the exhaust passageways which are connected to all of the combustion chambers during the engine warming-up period for quickly activating the catalytic converter just after starting a cold engine.

According to the present invention, an internal combustion engine is provided, comprising:

an engine body provided therein with a plurality of combustion chambers;

an intake system connected to each of the combustion chambers for introducing a combustible mixture into the chambers;

an exhaust system having branch passageways, each of which is on one end thereof, connected to a corresponding combustion chamber for receiving a resultant exhaust gas therefrom;

a catalytic device disposed in the exhaust system located downstream of the branch passageways for oxidizing unburnt components remaining in the exhaust gas;

an exhaust gas recirculating passageway means for recirculating the exhaust gas issued from the exhaust system into the intake system, such exhaust gas recirculating passageway means being connected to at least one but not all of the branch passageways;

an air pump means;

a first air injection means connectable to the air pump means after the engine has fully warmed up, for introducing an appropriate amount of air into the exhaust system for causing the exhaust gas recirculation operation to maintain an effective $NO_x$ component decreasing effect; and, a supplementary air injection means for introducing secondary air into the branch passageways at positions located near the combustion chambers, when the engine is operating under a warming-up condition, during which the catalytic device is not fully activated.

Accordingly, an excessive amount of air for causing the catalytic converter to be quickly activated is introduced into the exhaust system during such warming-up condition.

Therefore, an increase in the emissions of HC and CO components during the warming-up period is effectively prevented.

DESCRIPTION OF PREFERRED EMBODIMENTS

Figure 1:
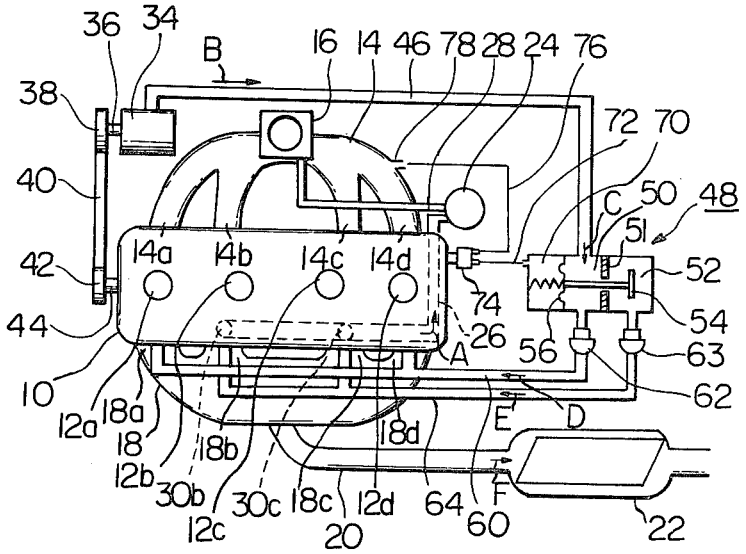
FIG. 1 shows a schematic diagram of an internal combustion engine according to the present invention.

FIG. 1 schematically illustrates a four-cylinder internal combustion engine according to the first embodiment of the present invention. The engine has an engine body 10 provided therein with four combustion chambers 12*a*, 12*b*, 12*c* and 12*d*. A carburetor 16 for forming a combustible mixture therein is connected to an intake manifold 14. The intake manifold 14 has four branch pipes 14*a*, 14*b*, 14*c* and 14*d*, which are connected, via corresponding intake ports formed in the engine body, to the combustion chambers 12*a*, 12*b*, 12*c* and 12*d*, respectively. An exhaust manifold 18 has, at the upstream end thereof, four branch pipes 18*a*, 18*b*, 18*c* and 18*d* which are connected, via corresponding exhaust ports formed in the engine body 10, to the combustion chambers 12*a*, 12*b*, 12*c* and 12*d*, respectively, for receiving exhaust gas therefrom. The exhaust manifold 18 is connected at the downstream end thereof to an exhaust pipe 20. A catalytic device 22 for oxidizing unburnt components remaining in the exhaust gas is disposed in the exhaust pipe 20. The catalytic device 22 can be an oxidizing catalytic converter or a three-way catalytic converter.

A numeral 24 denotes an exhaust gas recirculation control device (a so-called EGR device) for controlling the amount of exhaust gas to be recirculated from the exhaust manifold 18 to the intake manifold 14. The EGR device has an exhaust gas recirculating passageway (EGR passageway) 26 for diverting an amount of exhaust gas into the control device 24 from at least one but not all of the combustion chambers 12*a*, 12*b*, 12*c* and 12*d*. In the embodiment shown in FIG. 1, the EGR passageway 26 is connected to an exhaust port 30*b* which connects the combustion chamber 12*b* to the exhaust manifold branch pipe 18*b* and to the exhaust port 30*c* which connects the combustion chamber 12*c* to the branch pipe 18*c*. Thus, exhaust gas from the combustion chambers 12*b* and 12*c* is diverted to the EGR device 24 via the EGR passageway 26 as shown by the arrow A in FIG. 1. The EGR device 24 has another EGR passageway 28 connected to the intake manifold 14 for introducing the recirculated exhaust gas thereto.

An air pump 34 has a drive shaft 36 kinematically connected to a crankshaft 44 of the engine body 10 by way of a pulley 38, a belt 40 and another pulley 42. An outlet port of the air pump 34 is connected to an air pipe 46 which receives air supplied from the air pump 34, as shown by the arrow B in FIG. 1.

Reference numeral 48 denotes a vacuum-operated control valve which has an air chamber 50. An end of the air pipe 46 is connected to the air chamber 50. Thus secondary air from the air pipe 46 is introduced into the chamber 50 as shown by the arrow C in FIG. 1. The valve 48 has a second air chamber 52. A valve seat 51 is located between the air chambers 50 and 52. A valve member 54 faces the valve seat 51 and is mechanically connected to a spring-urged diaphragm 56 for urging the valve member 54 away from the valve seat 51. The valve member 54 is seated on or detached from the valve seat 51 in accordance with the vacuum level in a vacuum chamber 70 formed on one side of the diaphragm 56. A vacuum signal from the intake manifold 14 can be transmitted to the chamber 70 as will be fully described later.

The air chamber 50 communicates with a first air injection pipe 60 on one end thereof. The pipe 60 is connected on the other end thereof to the branch pipes 18*a* and 18*d* of the exhaust manifold 18 at a position located near the corresponding combustion chambers 12*a* and 12*d* which are not connected to the EGR passageway 26. Thus, secondary air introduced into a position near the combustion chamber can oxidize unburnt components remaining in the gas exhausted therefrom, causing the temperature of the exhaust gas to be increased.

(It should be noted that the pipe 60 may be connected to exhaust ports which connect the branch pipes 18*a* and 18*d* to the combustion chambers 12*a* and 12*d*, respectively. This arrangement is advantageous for effectively increasing the temperature of the exhaust gas.) A well-known check valve 62 is disposed on the pipe 60.

The second air chamber 52 communicates with a second air injection pipe 64 on one end thereof. The pipe 64 is connected on one end thereof to the branch pipes 18*b* and 18*c* of the exhaust manifold 18, from which exhaust gas to be recirculated is diverted as shown by the arrow A in FIG. 1. (It should be noted that the pipe 64 may be directly connected to the exhaust ports 30*b* and 30*c*.) Another check valve 63 located on the pipe 64 prevents the exhaust gas from reaching the valve 48.

Reference numeral 74 is a vacuum actuator valve which detects an engine warming-up period during which the catalytic device 22 is not fully activated because the temperature of the exhaust gas just after starting of the engine is low. The vacuum actuator 74 can be an engine cooling water sensor valve operating to detect the temperature of the cooling water in the engine body 10. The valve 74 is located between a vacuum tube 72 opened to the chamber 70 and another vacuum tube 76 opened to a vacuum port 78. When the temperature of the cooling water is lower than the predetermined valve, the valve 74 is switched to its "closed condition" by which the vacuum tubes 72 and 76 are disconnected from each other. Therefore, no vacuum force is generated on the diaphragm 56 for detaching the valve member 54 from the valve seat 51. As a result, the air chamber 50 is caused to communicate with the air chamber 52. When the temperature of the cooling water is higher than the predetermined value, the valve 74 is switched to its "open condition" by which the vacuum tubes 72 and 76 are connected with each other. Consequently, a vacuum force is generated on the diaphragm 56 for resting the valve member 54 on the valve seat 51, causing the air chamber 50 to be disconnected from the air chamber 52.

In place of the vacuum actuator valve 74 for detecting the temperature of the engine cooling water, a valve which can detect the temperature of the engine lubrication oil or the opening of a carburetor choke valve may be utilized.

The operation of the above-mentioned apparatus is illustrated hereinafter.

Warming-Up Condition

When the engine is operating under a warming-up condition during which the temperature of the exhaust gas is not fully increased since a sufficient period of time has not elapsed from the starting of the engine, the temperature of the engine cooling water is lower than the predetermined temperature, which causes the vacuum actuator 74 to be in its "closed condition" thereby preventing fluid from communicating between the vacuum tube 76 with the vacuum tube 72. Accordingly, the valve member 54 of the control valve 48 is detached from the valve seat 51, thus causing the first air chamber 50 to communicate with the second air chamber 52. As a result, secondary air supplied to the chamber 50 from the air pump 34 is introduced not only into the branch pipes 18*a* and 18*d* of the exhaust manifold 18 via the first air injection pipe 60, as shown by the arrow D in FIG. 1, but also into the branch pipes 18*b* and 18*c* via the second air injection pipe 64, as shown by an arrow E in FIG. 1. Accordingly, a large amount of secondary air, which comes into contact with the unburnt components remaining in the exhaust gas in the exhaust manifold 18, is introduced into the exhaust manifold. Since the position where the air injection pipes 60 and 64 are connected to the exhaust manifold is located near the combustion chambers 12*a* to 12*d*, the temperature of the exhaust gas is high enough to cause oxidation of the unburnt components remaining in the exhaust gas, thereby increasing the temperature of the exhaust gas. The exhaust gas of the increased temperature is directed into the catalytic converter 22 as shown by the arrow F in FIG. 1.

As a result, the catalytic converter 22 is rapidly activated just after the starting of the engine for oxidizing and cleaning the CO and HC components in the exhaust gas.

Since the secondary air is introduced into the branch pipes 18*b* and 18*c* connected to the exhaust port 30*b* and 30*c* to which the EGR passageway 26 is connected, secondary air from the air injection pipe 64 is mixed with the exhaust gas to be recirculated via the passageway 26 as shown by the arrow A in FIG. 1, which causes an inferior effect of EGR operation. However, the inferior EGR effect does not cause an increase in the $NO_x$ emission to the atmosphere, since the amount of $NO_x$ in the exhaust gas is rather small during the warming-up period.

Normal Running Condition

After a sufficient period of time has elapsed from the starting of the engine, the temperature of the exhaust gas directed to the catalytic converter 22 is fully increased for obtaining an effective operation of the converter 22. In this case, since the temperature of the engine cooling water increases higher than the predetermined temperature, the vacuum actuator 74 is switched to its "opened condition" by which the fluid can communicate between the vacuum tubes 72 and 76. As a result, the valve member 54 of the control valve 48 is seated on the valve seat 51 for disconnecting the air chamber 50 from the air chamber 52. Accordingly, air is prevented from entering into the branch pipes 18*b* and 18*c*, connected to the exhaust port 30*b* and 30*c* from which the EGR gas is recirculated. Thus, the secondary air is not mixed with the EGR gas, and an $NO_x$ decreasing effect by the EGR operation is attained. Since the temperature of the exhaust gas directed to the catalytic converter is already high, CO and HC components in the exhaust gas are effectively oxidized.

Figure 2:
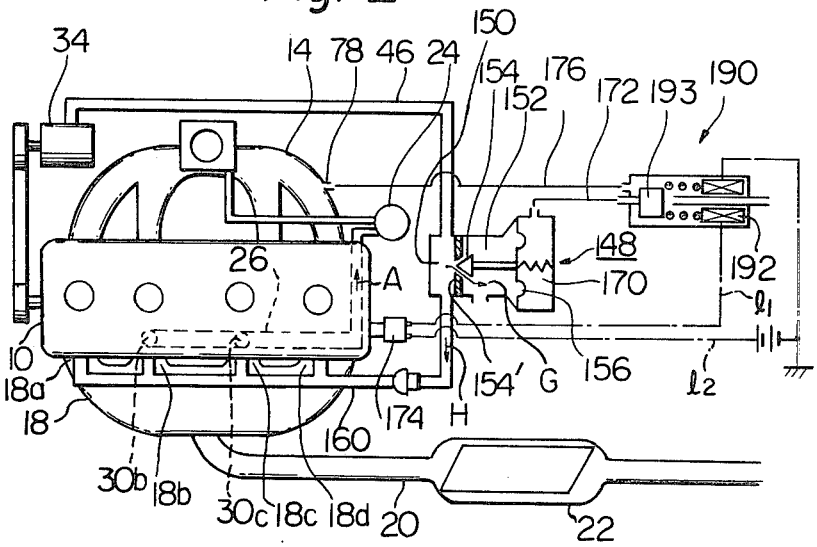
FIG. 2 shows a second embodiment of the invention.

A second embodiment of the present invention is shown in FIG. 2. In the embodiment only one air injection pipe 160 is used, which pipe is connected to all of the branch pipes 18*a*, 18*b*, 18*c* and 18*d*, for introducing secondary air thereinto. A flow control valve 148 has a first air chamber 150 which is located between the air injection pipe 160 and an air pipe 46. The chamber 150 is connected, by a valve mechanism comprised of a valve member 154 and a valve seat 154', to a second air chamber 152 opened to the atmosphere. Thus, the amount of air, directed into the second air chamber 152 from the first air chamber 150, as shown by an arrow G in FIG. 2, is controlled in accordance with the position of the valve member 154 with respect to the valve seat 154'. The valve member 154 is connected to a spring-urged diaphragm 156 for urging the valve member 154 toward the valve seat 154'. A vacuum signal chamber 170 formed on one side of the diaphragm 156 is connected to a vacuum port 78 via a vacuum tube 172, an electromagnetic vacuum switching valve 190 and a vacuum tube 176. The vacuum switching valve 190 located between vacuum tubes 172 and 176 has a valve member 193 and a solenoid 192. A switch 174 for detecting the temperature of the cooling water of the engine is mounted to the engine body 10. A contact of the switch 174 is connected to the solenoid 192 by an electric line $l_1$. Another contact of the switch 174 is connected to a battery by an electric line $l_2$. When the temperature of the cooling water is lower than a predetermined temperature, the switch 174 is in its OFF position which prevents electric current from being generated in the solenoid 192. The valve member 193 is thus situated so that the vacuum tube 176 is disconnected from the vacuum tube 172, thereby preventing a vacuum force from being produced in the diaphragm 156 of the flow control valve 148. As a result, the valve member 154 is seated on the valve seat 154'.

When the temperature of the cooling water of the engine is higher than the predetermined temperature, the switch 174 is in its ON position which generates an electric current in the solenoid 192. The valve member 193 is located to such a position that the vacuum tube 176 is connected to the vacuum tube 172, thereby causing a vacuum force to be generated in the diaphragm 156. Consequently, the valve member 154 is detached from the valve seat 154'. The distance between the valve member 154 and the valve seat 154', which corresponds to the amount of air directed into the chamber 152, as shown by the arrow G in FIG. 2, is proportional to the vacuum force on the diaphragm 156, which force corresponds to the vacuum level at the port 78. Since the load of the engine is inversely proportional to the vacuum level at the port 78, as is well-known to those skilled in this art, the amount of air diverted to the chamber 152 as shown by the arrow G in FIG. 2 becomes inversely proportional to the load of the engine. Thus, the amount of secondary air directed to the air injection pipe 160, as shown by the arrow H in FIG. 2, is proportional to the engine load, i.e. to the amount of exhaust gas passed through the exhaust manifold 18.

It should be noted that in place of the switch 174 for sensing the temperature of the engine cooling water, other known types of switches for sensing the temperature of the engine lubricant oil or for sensing the degree of opening of the carburetor choke valve may be conveniently utilized.

The operation of the second embodiment is illustrated hereinbelow.

Warming-Up Condition

Before a sufficient period of time has elapsed after the starting of the engine, the switch 174 will be in its OFF condition due to the low temperature of the cooling water in the engine body 10. Accordingly, the valve member 193 of the electromagnetic valve 190 is situated so that the vacuum tube 172 is disconnected from the vacuum tube 172. As a result, no vacuum force is generated on the diaphragm 156, and the valve member 154 is therefore rested on the valve seat 154'. Due to the above-condition, all of the air introduced into the chamber 150 is directed into the air injection pipe 160, as shown by an arrow H in FIG. 2. An excessive amount of secondary air introduced into all of the branch pipes 18*a*, 18*b*, 18*c* and 18*d* of the exhaust manifold 18 operate to oxidize the unburnt component remaining in the exhaust gas of a relatively high temperature for increasing the temperature of the exhaust gas directed to the catalytic device 22. The device 22 is thus rapidly activated just after the starting of the engine. Thus, CO and HC emissions during the warming-up condition are effectively suppressed.

Normal Running Condition

When the temperature of the cooling water is fully increased, the switch 174 will be in its ON condition, thereby causing the valve member 193 to be located in such a position that the vacuum tube 176 communicates with the vacuum tube 172. Accordingly, the amount of air diverted into the chamber 152 from the chamber 150 as shown by the arrow G becomes proportional to the vacuum force of the diaphragm 156. As a result, the amount of secondary air directed into the air injection pipe 160, as shown by the arrow H in FIG. 2, becomes proportional to the load of the engine, as has already been described. Thus, an amount of air corresponding to the amount of exhaust gas is introduced into all of the branch pipes 18*a*, 18*b*, 18*c* and 18*d* of the exhaust manifold 18, which air causes the HC and CO components to be oxidized by the catalytic device 22. In this second embodiment, since the secondary air is always introduced into the branch pipes 18*b* and 18*c* connected to the exhaust ports 30*b* and 30*c* to which the EGR passageway 26 is connected, the mixing of introduced air with the exhaust gas to be recirculated via the EGR passageway 26, as shown by the arrow A in FIG. 2, occurs. However, the amount of $NO_x$ components remaining in the exhaust gas does not increase, since the amount of secondary air directed to the exhaust manifold 18 via the air injection pipe 160, as shown by the arrow H in FIG. 2 is appropriately controlled so that the ratio of the secondary air amount to the exhaust gas amount is maintained at a substantially constant valve by the operation of the flow control valve 148.

Figure 3:
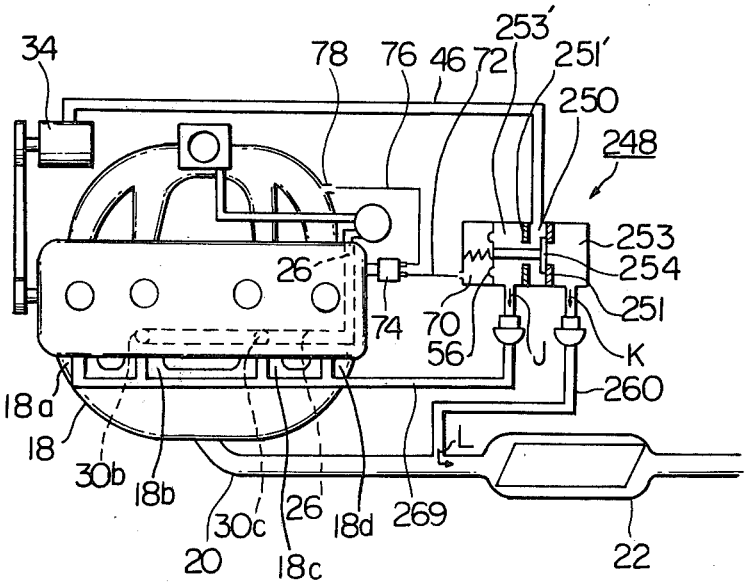
FIG. 3 shows a third embodiment of the invention.

The third embodiment of the present invention shown by FIG. 3 differs from the first embodiment shown by FIG. 1 in that the first injection pipe 260 is connected to the exhaust pipe 20 located slightly upstream of the catalytic converter 22, in that the second air injection pipe 264 is connected to all of the branch pipes 18*a*, 18*b*, 18*c* and 18*d* of the exhaust manifold 18, and in that a control valve 248 is utilized for selectively connecting the air pipe 46 with the first injection pipe 260 or with the second injection pipe 274. The control valve 248 has a common chamber 250 connected to the air pipe 46. A first chamber 253 and a second chamber 253' are formed on the sides of the chamber 250. A valve member 254 is situated between a valve seat 251 and another valve seat 251'.

Connected to the valve member 254 is a diaphragm 56, on one side of which a vacuum chamber 70 is formed. The vacuum chamber 70 is connected to a vacuum port 78 via a vacuum tube 72, a vacuum switching valve 74 and a vacuum tube 76. The vacuum switching valve 74, which operates as already described in the first embodiment, is located in such a position that the vacuum tube 72 is disconnected from the vacuum tube 76 when the temperature of the engine cooling water is low. Thus, no vacuum force is generated on the diaphragm 56, thereby causing the valve seat 254 to be rested on the valve seat 251. The common air chamber 250 is then communicated with the second air chamber 253'.

When the temperature of the cooling water becomes sufficiently high, the vacuum switching valve 74 is located in such a position that vacuum tube 72 is connected to the vacuum tube 76. Thus, a vacuum force is generated on the diaphragm 56, thereby causing the common chamber 250 to communicate with the first air chamber 253.

The operation of the third embodiment is described hereinbelow.

Warming-Up Condition

When the temperature of the exhaust gas is not yet fully increased during the warming-up condition of the engine, the valve member 254 of the control valve 248 is rested on the valve seat 251, since the vacuum switching valve 74 prevents the transmission of a vacuum signal from the vacuum port 78 into the vacuum chamber 70. Thus, air in the common chamber 250 is directed into the second air injection pipe 269 as shown by an arrow J in FIG. 3, and then introduced into all of the branch pipes 18*a*, 18*b*, 18*c* and 18*d*. The introduced secondary air oxidizes the unburnt components of the exhaust gas in the exhaust manifold 18. Accordingly, the temperature of the exhaust gas directed into the catalytic device 22 is rapidly increased just after the starting of the engine.

Normal Running Condition

When the temperature of the cooling water is fully increased after a period of time has lapsed after the cold starting of the engine, the vacuum switching valve 74 is located so that the vacuum tube 76 is connected with the tube 72, thereby causing the valve member to rest on the valve seat 251'. Because introduction of air into the pipe 269 is thus prevented, air is not mixed with the exhaust gas to be directed into the EGR passageway 26 from the exhaust ports 30*b* and 30*c*. As a result, an idealized EGR operation is carried out for effectively preventing the emission of $NO_x$.

Air in the common chamber 250, now communicating with the first air chamber 253 is directed to the first air injection pipe 260 as shown by the arrow K in FIG. 3. The direction air is introduced into the exhaust pipe 20, as shown by the arrow L in FIG. 3, for oxidizing CO and HC components remaining in the exhaust gas at the location of the catalytic converter 22.

What is claimed is:

1. An internal combustion engine comprising:

an engine body provided therein with a plurality of combustion chambers;

an intake system connected to each of the combustion chambers for introducing a combustible mixture into the chambers;

an exhaust system having branch passageways each of which on one end thereof is connected to a corresponding one of the combustion chambers for receiving resultant exhaust gas therefrom;

a catalytic converter disposed in the exhaust system downstream of the branch passageways for oxidizing unburnt components remaining in the exhaust gas;

an exhaust gas recirculating passageway means for recirculating exhaust gas from the exhaust system into the intake system, which exhaust gas recirculating passageway means is connected to at least one but not all of the branch passageways;

an air pump means operated by the engine;

a main air injection means for introducing, after the engine has fully warmed up, an appropriate amount of air from the air pump means into the exhaust system for maintaining an effective $NO_x$ component decreasing effect produced by the exhaust gas recirculation operation;

a supplementary air injection means for introducing, when the engine is operating under a warming up condition during which the catalytic device is not fully activated, an excessive amount of secondary air directly into the branch passageways at positions located near the combustion chambers, said excessive amount of air operating to cause the catalytic converter to be quickly activated;

said main air injection means comprises a first air injection pipe means adapted for connecting the air pump means always with at least one branch passageway at a position located near a corresponding one of said combustion chambers, to which passageway the exhaust gas recirculating passageway means is not connected; and said supplementary air injection means comprises: a second air injection pipe means connected, on one end thereof, to the branch passageways to which the exhaust gas recirculating passageway means is connected; an operating valve means located between the first air injection pipe means and the second air injection pipe means; and an actuator means for operating the operating valve means to cause the first air injection pipe means to communicate with the second air injection pipe means when the engine is operating under the warming-up condition.

* * * * *